US007836616B2

(12) United States Patent
Esser et al.

(10) Patent No.: US 7,836,616 B2
(45) Date of Patent: Nov. 23, 2010

(54) LOADER COUPLER WITH MULTIPLE PICK-UP LOCATIONS

(75) Inventors: Timothy C. Esser, Medina, OH (US); Ray S. Fatemi, San Marcos, CA (US)

(73) Assignee: Attachment Technologies, Inc., Cedar Rapids, IA (US)

( * ) Notice: Subject to any disclaimer, the term of this patent is extended or adjusted under 35 U.S.C. 154(b) by 48 days.

(21) Appl. No.: 11/936,359

(22) Filed: Nov. 7, 2007

(65) Prior Publication Data

US 2008/0141566 A1 Jun. 19, 2008

Related U.S. Application Data

(60) Provisional application No. 60/857,668, filed on Nov. 8, 2006.

(51) Int. Cl.
*E02F 3/96* (2006.01)

(52) U.S. Cl. ..... 37/468; 37/403; 414/723

(58) Field of Classification Search ..... 37/468, 37/403; 414/723; 403/24, 322.1, 408.1; 172/683, 272, 275
See application file for complete search history.

(56) References Cited

U.S. PATENT DOCUMENTS 3,243,066 A * 3/1966 Gardner et al. ..... 414/698
3,272,264 A * 9/1966 Antolini ..... 172/273
3,705,656 A * 12/1972 Hunger et al. ..... 414/723
3,760,883 A 9/1973 Birk
4,208,163 A * 6/1980 Holmqvist ..... 414/723
4,243,356 A 1/1981 Takojima
4,586,867 A * 5/1986 Stafford ..... 414/723
4,708,579 A 11/1987 Baird et al.
4,812,103 A 3/1989 Cochran et al.
4,963,071 A 10/1990 Larwin et al.
5,049,027 A * 9/1991 Morrison et al. ..... 414/723
5,088,882 A * 2/1992 Lovitt, Jr. ..... 414/723
5,310,275 A * 5/1994 Lovitt ..... 403/322.3
5,415,235 A 5/1995 Gebauer
5,529,419 A * 6/1996 Gebauer ..... 403/24
5,590,483 A 1/1997 Kim
5,692,850 A * 12/1997 Kimble et al. ..... 403/24
5,732,488 A * 3/1998 Smith ..... 37/468
5,820,332 A 10/1998 Philips et al.
5,865,594 A * 2/1999 Kim ..... 414/723
6,196,595 B1 * 3/2001 Sonerud ..... 285/26
6,227,792 B1 5/2001 Baker et al.
6,386,822 B1 5/2002 Burr
6,860,706 B2 3/2005 Godwin et al.
6,886,279 B2 * 5/2005 Kimble ..... 37/468

(Continued)

*Primary Examiner*—Thomas A Beach
*Assistant Examiner*—Matthew R Buck
(74) *Attorney, Agent, or Firm*—Fay Sharpe LLP

(57) ABSTRACT

A loader coupler includes left and right inner rib mounts that mate with left and right ribs of a first type of attachment coupling structure. The coupler also includes left and right outer rib mounts that mate with left and right ribs of a second type of attachment coupling structure. Left and right plunger assemblies each move between a locked and unlocked position and each includes both a first lock plunger and a second lock plunger. The left and right first lock plungers extend into left and right inner locking regions when the left and right plunger assemblies are located in the locked position. The left and right second lock plungers extend into left and right outer locking regions when the left and right plunger assemblies are located in the locked position.

14 Claims, 10 Drawing Sheets

U.S. PATENT DOCUMENTS 6,899,509 B1 * 5/2005 Mailleux ..... 414/723
6,991,398 B2 * 1/2006 Leemans et al. ..... 403/324
7,014,385 B2 3/2006 Lim et al.
7,182,546 B1 * 2/2007 Kimble ..... 403/322.3
7,225,566 B1 * 6/2007 Kimble ..... 37/468
7,337,564 B2 * 3/2008 Kimble ..... 37/468

* cited by examiner

LOADER COUPLER WITH MULTIPLE PICK-UP LOCATIONS

CROSS-REFERENCE TO RELATED APPLICATION

This application claims priority from and benefit of the filing date of U.S. provisional application Ser. No. 60/857,668 filed Nov. 8, 2006 and said provisional application Ser. No. 60/857,668 is hereby expressly incorporated by reference into the present specification.

BACKGROUND

Couplers for releasable connection of construction attachments to front-end loaders and the like are well-known. Typically, the loader coupler is operably connected to the front-end loader (sometimes simply referred as a "loader") or like machine by a pivoting "pin-on" connection. The loader coupler structure includes first and second pick-up points and corresponding first and second locks. The various construction attachments adapted to be releasably engaged by the coupler include first and second parallel spaced-apart ribs that are respectively engaged by the first and second loader pick-up points, and the first and second locks are engaged to capture the first and second ribs to the coupler so that the attachment is operably connected to the loader in order to perform work. Examples of such couplers and coupling systems are disclosed in commonly owned U.S. Pat. Nos. 4,708,579; 5,415,235; 5,529,419; and 5,692,850.

More recently, so-called hybrid loader couplers have been developed. These hybrid loader couplers include two separate sets or pairs of pick-up points that are adapted to mate with two different types of ribs spacings/structures of the attachments. A lock system is provided to capture the rib structures to coupler, regardless of which type of rib structure is engaged by the coupler. Examples of hybrid loader couplers are disclosed in commonly owned U.S. Pat. Nos. 7,225,566 and 7,182,546.

A need has recently been identified for a hybrid loader coupler that better maintains the preferred geometrical relationship between the attachment and the loader machine as compared to the above-referenced loader couplers, and that provides an improved locking system for capturing the attachment ribs to the coupler.

SUMMARY

In accordance with one aspect of the present development, a loader coupler comprises a body including a front region, a rear region, an upper region, a lower region, and left and right lateral sides, a tilt actuator pin-on location, and left and right arm pin-on locations. Left and right laterally spaced-apart inner rib mounts are provided on the body and are adapted to mate respectively with left and right ribs of a first type of attachment coupling structure. Left and right inner locking regions are defined by the body and are vertically aligned with the left and right inner rib mounts, respectively. Left and right laterally spaced-apart outer rib mounts are provided on the body and are adapted to mate respectively with left and right ribs of a second type of attachment coupling structure. Left and right outer locking regions are defined by the body and are vertically aligned with the left and right outer rib mounts, respectively. A lock system includes left and right plunger assemblies that each move between a locked and unlocked position. The left and right plunger assemblies each include a first lock plunger located on a first lock plunger axis and a second lock plunger located on a second lock plunger axis. The left and right first lock plungers extend into the left and right inner locking regions when the left and right plunger assemblies are located in the locked position. The left and right first lock plungers are at least partially withdrawn from the left and right inner locking regions when the left and right plunger assemblies are located in the unlocked position. The left and right second lock plungers extend into the left and right outer locking regions when the left and right plunger assemblies are located in the locked position. The left and right second lock plungers are at least partially withdrawn from the left and right outer locking regions when the left and right plunger assemblies are located in the unlocked position.

In accordance with another aspect of the present development, a lock system for releasably capturing an associated attachment having either a first type of attachment coupling structure or a second type of attachment coupling structure to loader coupler body is provided. The lock system includes left and right plunger assemblies that each move between an extended position and a retracted position. The left and right plunger assemblies each include a first lock plunger and a second lock plunger.

In accordance with another aspect of the present development, a lock plunger assembly is provided for releasably capturing to loader coupler body an associated attachment having either a first type of attachment coupling structure or a second type of attachment coupling structure. The lock plunger assembly includes a plunger assembly base. First and second parallel, spaced-apart lock plungers are connected to the base and project outwardly from the base in a common direction.

DETAILED DESCRIPTION

Figure 1:
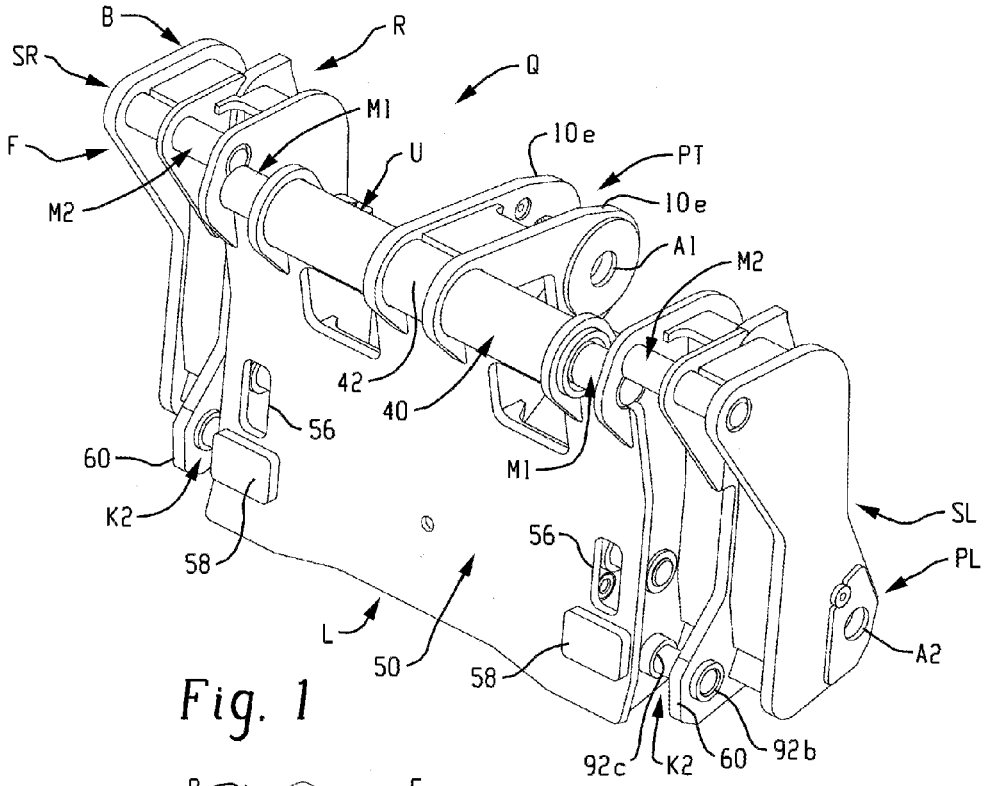
FIG. 1 is a front isometric view of a loader coupler with multiple pick-up locations formed in accordance with the present development.
Figure 2:
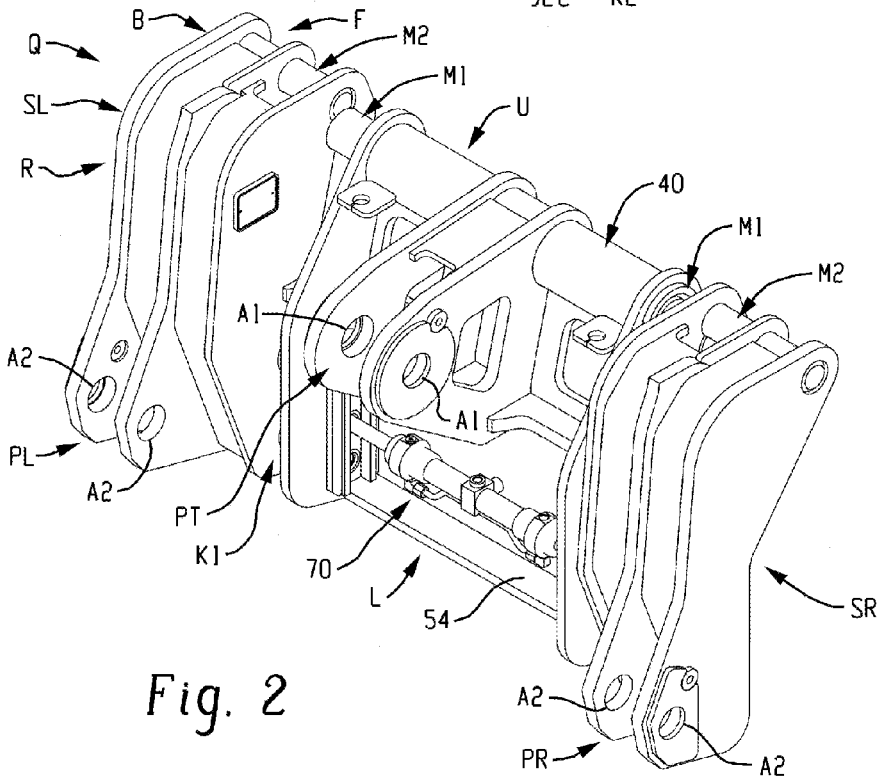
FIG. 2 is a rear isometric view of the loader coupler.
Figure 3:
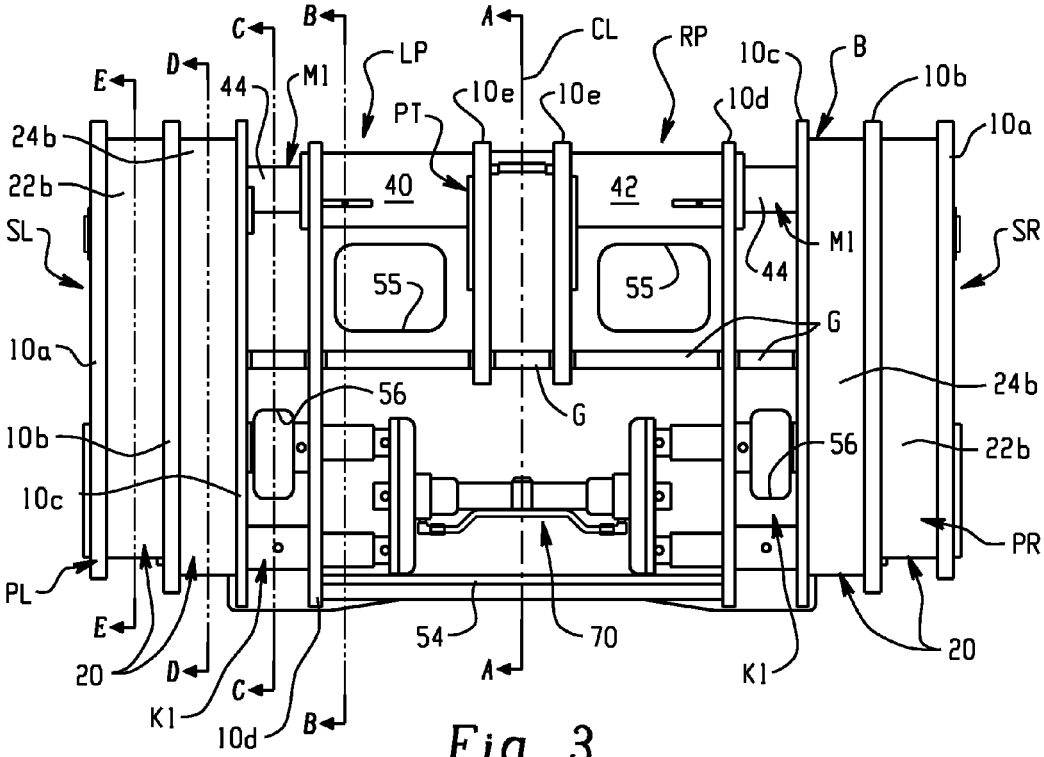
FIG. 3 is a rear elevational view of the loader coupler with the attachment locking system in its unlocked state.

FIGS. 1 and 2 are respective front and rear isometric views of an attachment quick coupler Q formed in accordance with the present development. The coupler Q comprises a frame or body B that has a rear (machine) side R and a front (attachment) side F, left and right lateral sides SL, SR, and upper and lower regions U, L. In the illustrated embodiment, as also shown in FIG. 3, the body B is symmetrically constructed about a vertical center line CL, at least with respect to the basic structure as described herein, so as to include left and right portions LP, RP defined between the centerline CL and the left and right lateral sides SL, SR, respectively.

Referring now to all of FIGS. 1-5E, the body B is constructed from steel components that are welded, fastened and/or otherwise connected. More specifically, the body B comprises multiple spaced-apart vertical ribs. In the illustrated embodiment, the left and right coupler portions LP, RP each comprise first, second, third, fourth and fifth vertical spaced-apart ribs 10*a*,10*b*,10*c*,10*d*,10*e* which are most easily seen at the rear R of the body. The ribs 10*a*-10*e* are preferably all arranged in parallel, spaced-apart relation to each other.

The two innermost (fifth) ribs 10*e* define a tilt actuator pin-on location PT (FIG. 2) by which a tilt-link or cylinder rod or other tilt actuator is operatively secured to the coupler body B. The ribs 10*e* define a channel between themselves and the ribs 10*e* include respective apertures A1 that are aligned with each other. An associated tilt actuator such as a tilt-link, rod-eye or the like of a loader or other associated machine to which the coupler body B is connected is inserted in the channel between the ribs 10*e* and pinned in position by a pin inserted into the aligned apertures A1 and through a bore defined in the associated tilt actuator to allow pivoting movement of the ribs 10*e* and, thus, the coupler body B relative to the associated tilt actuator.

The rear R of the coupler body B further comprises left and right pin-on locations PL, PR by which the coupler body is operatively connected to associated left and right arms of a loader or other associated machine, respectively, for pivoting movement of the body relative to the associated machine arms. In the illustrated embodiment, the outermost two ribs 10*a*,10*b* of the left/right coupler portions LP/RP define a channel therebetween that is adapted to receive the associated left/right machine arms. The ribs 10*a*,10*b* define respective aligned apertures A2 and the associated arms are secured to the coupler body B by insertion of pins through the aligned apertures A2 of the pin-on locations PL, PR and through an aligned bore in the associated machine arm.

In the illustrated example, the coupler body B comprises only a single tilt actuator pin-on location PT. In an alternative embodiment, the coupler body B comprises left and right laterally spaced-apart tilt actuator pin-on locations that are part of the left and right coupler portions LP, RP, respectively. In one example, these left and right tilt actuator pin-on locations are defined between the outer ribs 10*a*,10*b* of the left and right coupler portions LP, RP, with a structure corresponding to the left and right arm pin-on locations PL, PR, but spaced respectively above the locations PL, PR. With such an alternative structure, the coupler body B is adapted to be operably coupled to associated left and right machine arms at the locations PL, PR and is also adapted to be operably coupled to associated left and right tilt actuators at the left and right tilt actuator pin-on locations.

Figure 5C:
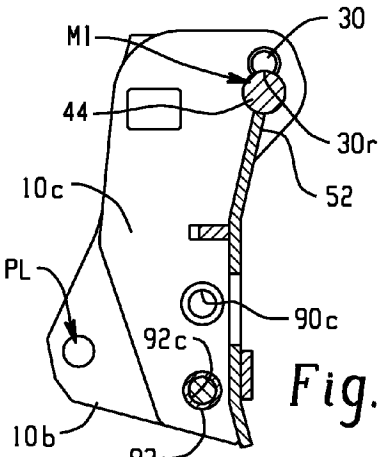
FIGS. 5A, 5B, 5C, 5D, 5E are sectional views A-A, B-B, C-C, D-D, E-E of FIG. 3, respectively.
Figure 5:
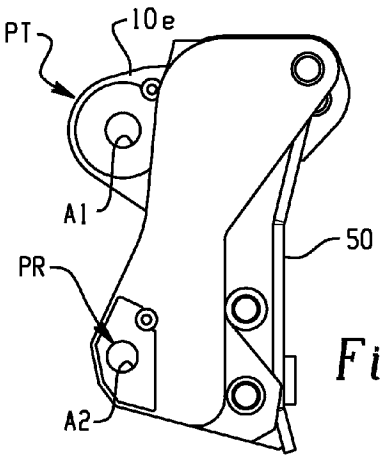
FIG. 5 is a side elevational view of the loader coupler.
Figure 5D:
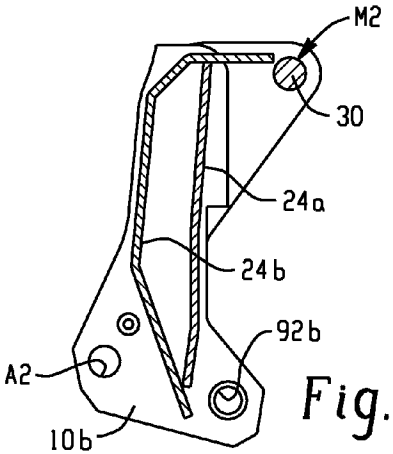

For both the left and right coupler portions LP, RP, the first, second and third ribs 10*a*,10*b*,10*c* are interconnected with a box frame 20 and also by an outer cross-bar 30 located adjacent the upper edge U of the coupler body. The illustrated outer cross-bars 30 each comprise a one-piece cylindrical bar or like structure installed in aligned apertures of the first, second and third ribs 10*a*,10*b*,10*c*, although it could be a multi-piece bar. The box frame 20 comprises spaced apart front and rear outer plates 22*a*,22*b* installed between and interconnecting the first and second ribs 10*a*,10*b* (see FIG. 5E) and comprises spaced-apart front and rear inner plates 24*a*,24*b* installed between and interconnecting the second and third ribs 10*b*,10*c* (see FIG. 5D).

The coupler body B further comprises a main upper support 40 that extends between and is connected to the fourth and fifth ribs 10*d*,10*e* of both the left and right coupler portions LP, RP and that extends between and interconnects the innermost (fifth) ribs 10*e* of the left and right coupler portions LP, RP. The main upper support 40 is located adjacent the upper edge U. In the illustrated embodiment, the main upper support 40 comprises a central one-piece tubular member 42 that is connected to both the innermost ribs 10*e* of the left/right coupler portions LP, RP and that extends laterally outward toward the left and right sides SL, SR of the body, extending through and connected to the left/right fourth ribs 10*d*.

Left and right inner cross-bars 44 are located between the third and fourth ribs 10*c*,10*d* of the left and right coupler portions LP, RP, respectively. The left/right inner cross-bars 44 have an outer ends installed in an aperture defined in the left/right third ribs 10*c*, and have inner ends that are, in the illustrated embodiment, installed in open left/right ends of the central tubular member 42. It can be seen in FIG. 5C that the left and right outer cross-bars 30 each include a recess 30*r* formed in an outer surface that accommodates the outer ends of the left and right inner cross-bars 44 where the outer and inner cross-bars 30,44 overlap which ties the two cross-bars 30,44 together.

Figure 5A:
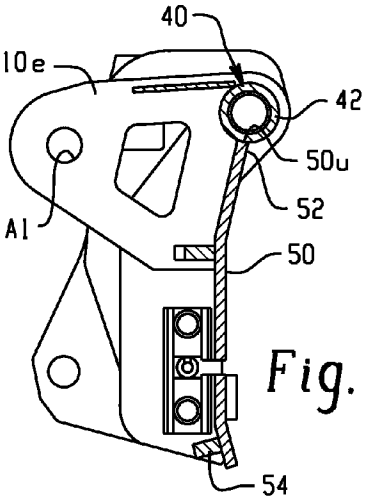
Figure 5E:
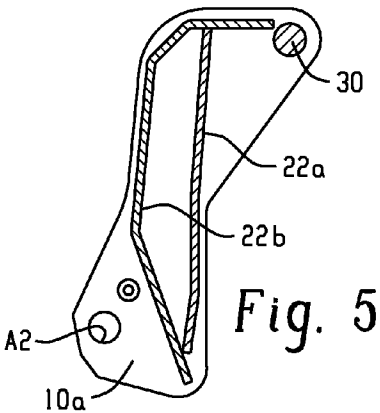
Figure 5B:
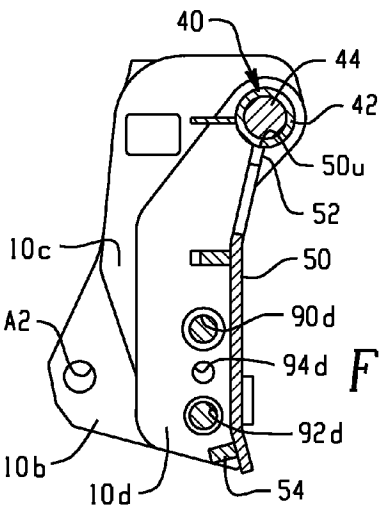

A face plate 50 extends laterally from the third rib 10*c* of the left coupler portion LP to the third rib 10*c* of the right coupler portion RP and extends in a general vertical direction from a location adjacent the main upper support 40 to a location adjacent the body lower edge L. The face plate 50 is connected to the third, fourth and fifth ribs 10*c*,10*d*,10*e* of both the left and right coupler portions LP, RP so as to tie the left and right coupler portions together. The face plate is preferably a one-piece construction. As shown in the sectional views of FIGS. 5A,5B,5C the ribs 10*c*,10*d*,10*e* include slots 52 into which an upper edge 50*u* of the face plate 50 is received and so that it abuts the main upper support 40. A lower cross-bar 54 is connected to a rear surface of the face plate 50 and extends laterally between and is connected to the left/right fourth ribs 10*d*. The coupler body B includes numerous other support ribs/gussets G (see e.g., FIG. 3) as shown in the drawings for added strength and rigidity as will be readily understood by one of ordinary skill in the art. One or more sight openings 55 are defined through the face plate 50 to allow an operator to see through the face plate from the rear side R of the coupler body B to the front side F.

For both the left and right coupler portions LP, RP, between the third and fourth ribs 10*c*,10*d*, the body B comprises inner rib pick-up points or rib mounts M1 that are defined by the inner cross-bars 44, preferably by a cylindrical surface thereof. Similarly, for both the left and right coupler portions LP, RP, between the second and third ribs 10*b*,10*c*, the body B comprises outer rib pick-up points or rib mounts M2 that are defined by the outer cross-bars 30, preferably by a cylindrical surface thereof.

Figure 6A:
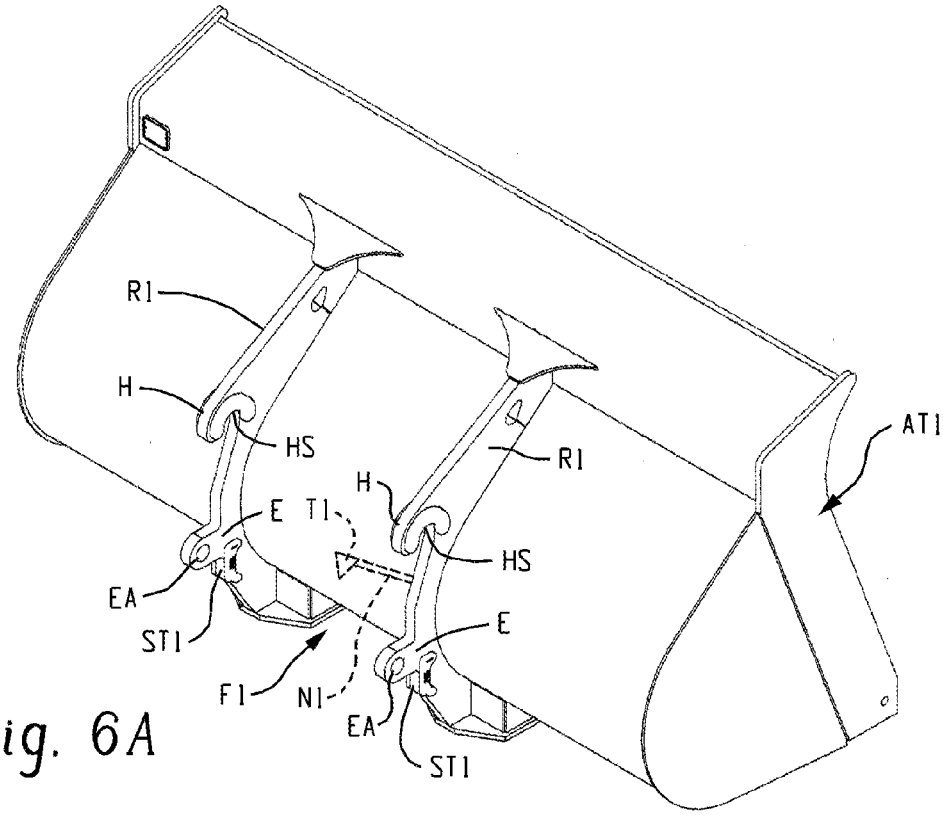
FIG. 6A illustrates an attachment including a first type of attachment coupling structure adapted to mate with the loader coupler of FIG. 1.
Figure 7A:
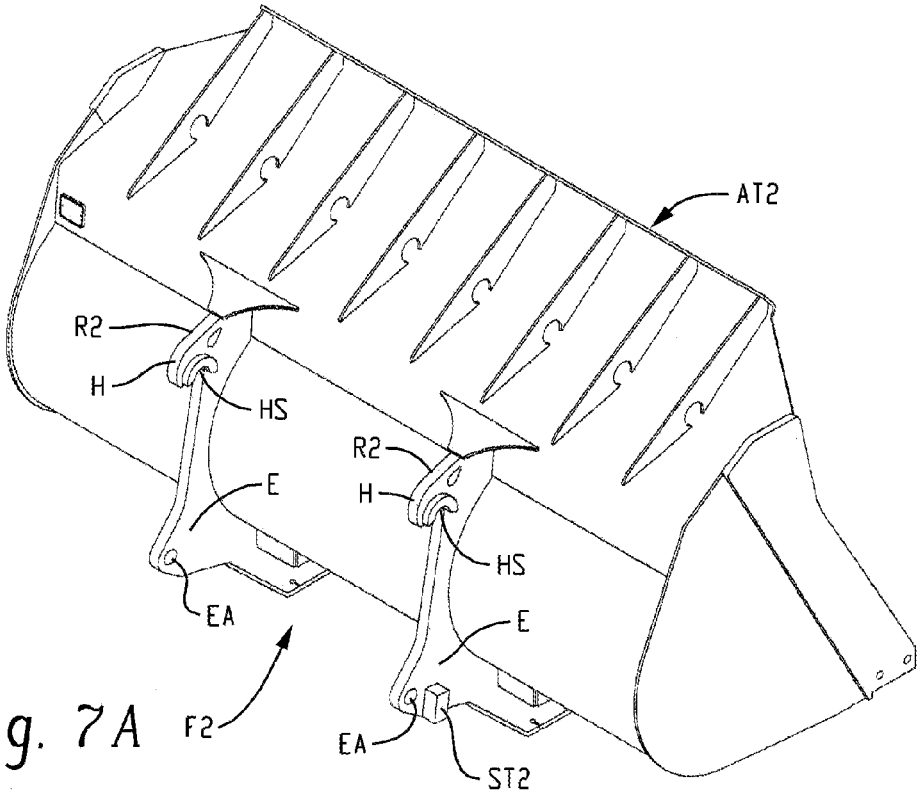
FIG. 7A illustrates an attachment including a second type of attachment coupling structure adapted to mate with the loader coupler of FIG. 1.

As described in more detail below, the left and right inner mounts M1 are adapted to mate with first type of attachment rib or coupling structure F1 (FIG. 6A) comprising left and right female ribs R1 connected to a bucket or other attachment AT1. The left and right outer mounts M2 are adapted to mate with a second type of attachment coupling structure F2 (FIG. 7A) comprising left and right female ribs R2 that are shaped differently as compared to the female ribs R1 and that are spaced-apart a different distance as compared to the spacing of the ribs R1 on a bucket or other attachment AT2. The female ribs R1,R2 each comprise a hook portion H that opens downward and comprises an inner cylindrical surface HS and an eye portion E spaced vertically below the hook portion H and comprising a laterally extending lock aperture EA that extends completely through the rib R1,R2. The hook portions H of the left/right female ribs R1 of the first type of attachment coupling structure F1 are adapted to mate respectively with the left/right inner rib mounts M1 of the coupler Q so that the left/right cylindrical hook surfaces HS closely abut a corresponding cylindrical surfaces of the left/right mounts M1. Similarly, the hook portions H of the left/right female ribs R2 of the second type of attachment coupling structure F2 are adapted to mate respectively with the left/right outer rib mounts M2 of the coupler Q so that the left/right cylindrical hook surfaces HS closely abut a corresponding cylindrical surfaces of the left/right mounts M2.

With reference again to FIGS. 1-5E, the left and right portions LP, RP of the coupler body B each further comprise an inner locking region such as a channel K1 (FIG. 3) defined between the third and fourth ribs 10*c*,10*d* behind the face plate 50 and spaced vertically below the inner rib mounts M1 which are also located between the third and fourth ribs 10*c*,10*d* as described above. Because the inner locking channels K1 are located behind the face plate 50, the face plate 50 includes left and right lock channel openings 56 that open into the left and right locking channels K1. Also, the face plate 50 comprises left and right stop surfaces or blocks 58 connected thereto or defined as a part thereof and located adjacent the left and right lock channel openings 56, respectively. The stop blocks 58 are abutted by the ribs R1 of the attachment coupling structure F1 when the ribs R1 are fully mated with the coupler Q.

The left and right portions LP, RP of the coupler body B each further comprise an outer locking regions such as a channel K2 (FIG. 4) defined between the second and third ribs 10*b*,10*c* in front of the box frame plates 24*a*,24*b* and spaced vertically below the outer rib mounts M2 which are also located between the second and third ribs 10*b*,10*c* as described above. The outer locking channels K2 open to the front F of the coupler body without obstruction because the locking channels K2 are located forward of the front and rear box frame inner plates 24*a*,24*b* between the second and third ribs 10*b*,10*c*, and because the face plate 50 does not extend laterally to the second rib 10*b*. The left and right second ribs 10*b* of the coupler body B include or define stop blocks/surfaces 60 adjacent the outer locking channels K2. The stop surfaces 60 are abutted by the ribs R2 of the attachment coupling structure F2 when the ribs R2 are fully mated with the coupler Q.

Figure 6B:
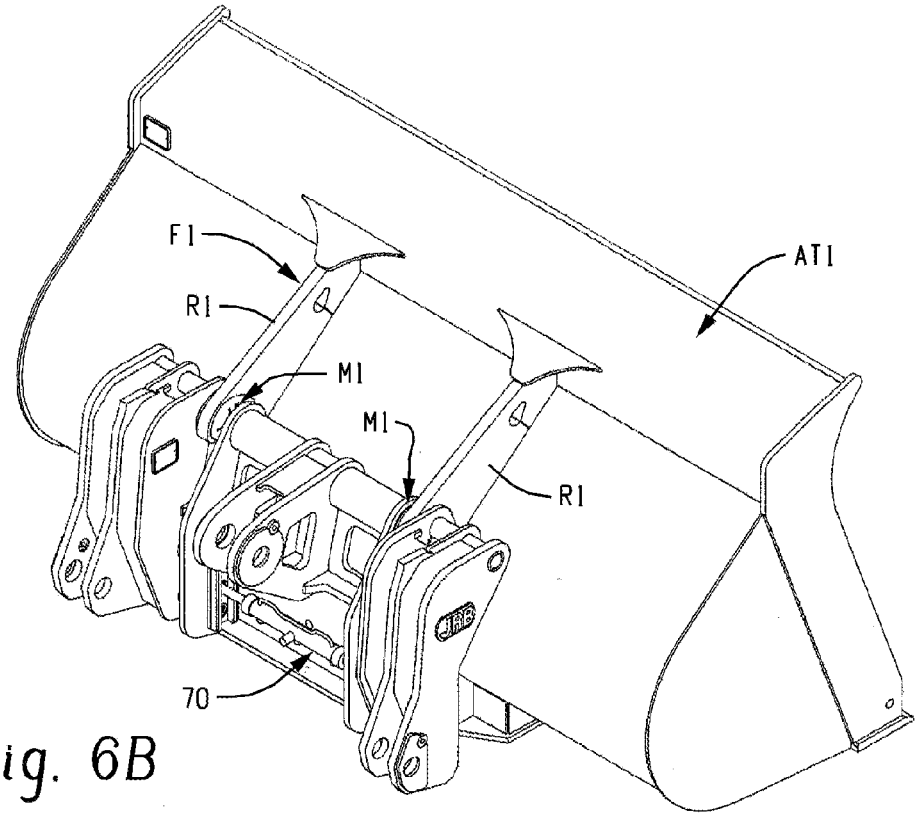
FIGS. 6B, 6C, 6D are isometric, rear and side views of the attachment of FIG. 6A mated with the loader coupler (with the locking system in its unlocked state)
Figure 6C:
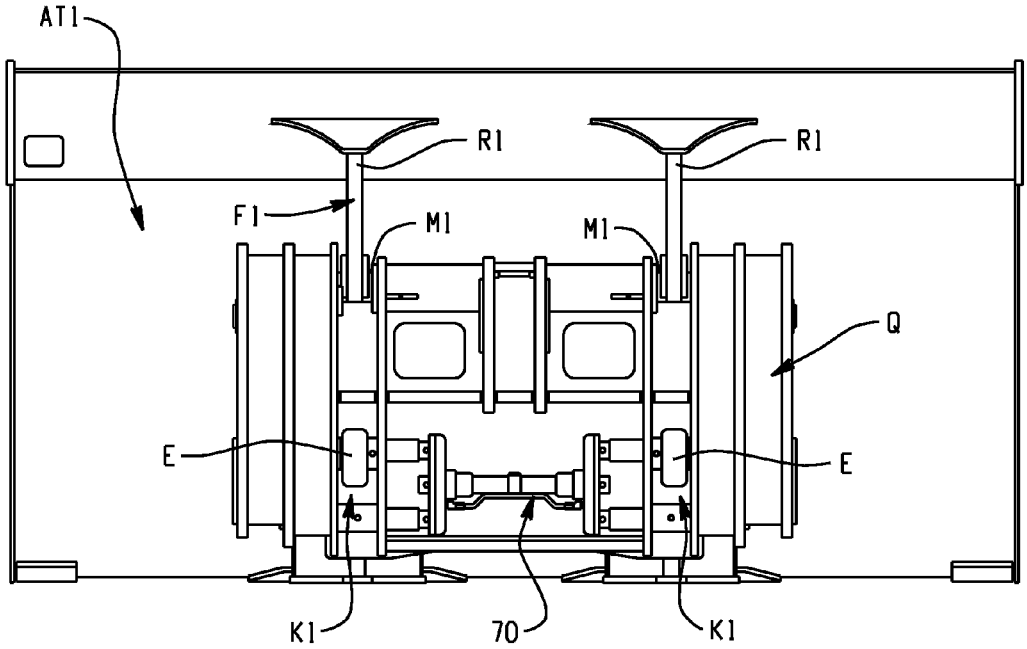
Figure 6D:
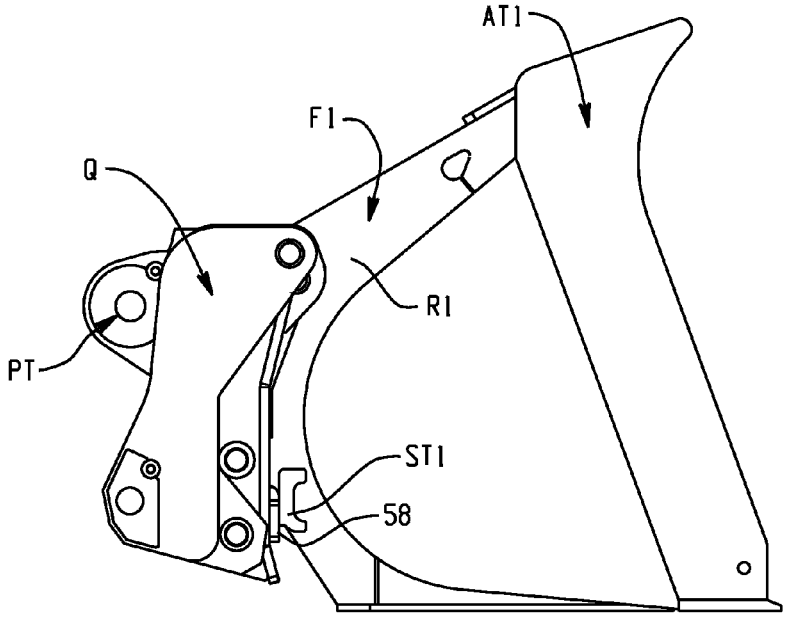
Figure 7B:
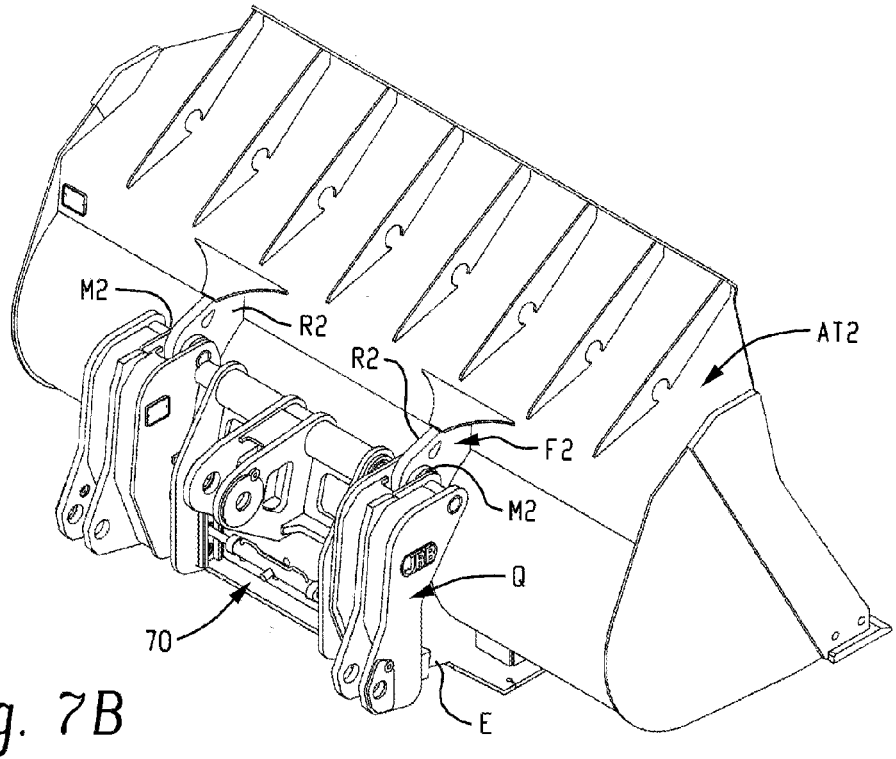
FIGS. 7B, 7C and 7D are isometric, rear and side views of the attachment of FIG. 7A mated with the loader coupler (with the locking system in its unlocked state)
Figure 7C:
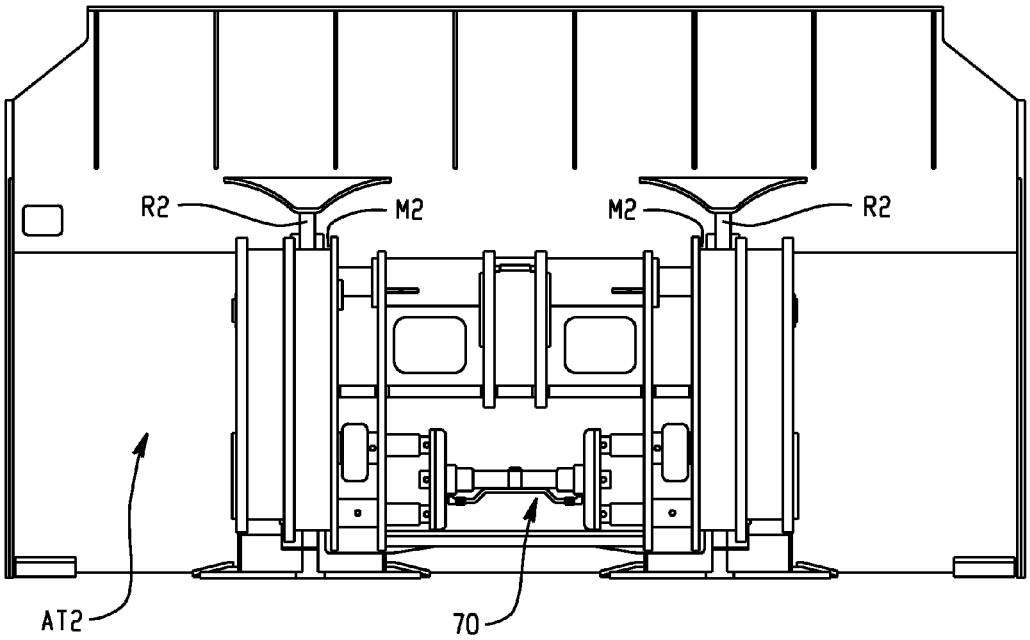
Figure 7D:
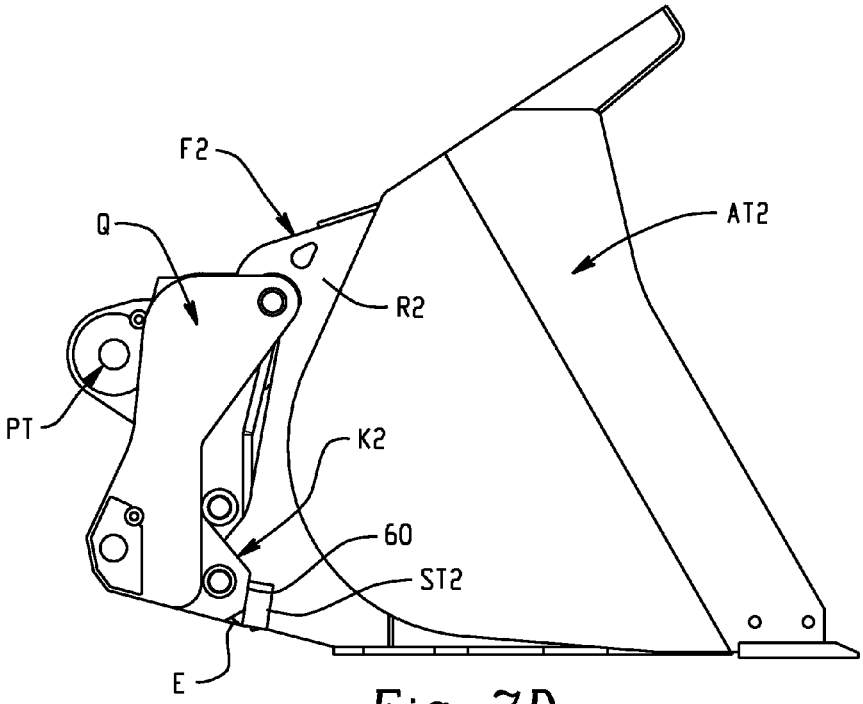

As shown in FIGS. 6B, 6C, 6D, when the female ribs R1 of the first type of attachment coupling structure F1 are fully mated with the inner coupler mounts M1, the eye portions E of the left and right female ribs R1 project into the left and right inner locking channels K1 through the lock channel openings 56 with stop portions ST1 of the left and right female ribs R1 are abutted with the left and right stop blocks 58, respectively. Alternatively, in a corresponding fashion, as shown in FIGS. 7B, 7C, 7D, when the female ribs R2 of the second type of attachment coupling structure F2 are fully mated with the outer coupler mounts M2, the eye portions E of the left and right female ribs R2 extend into the left and right outer locking channels K2 with stop portions ST2 of the left and right female ribs R2 abutted with the left and right stop surfaces 60, respectively.

Figure 8:
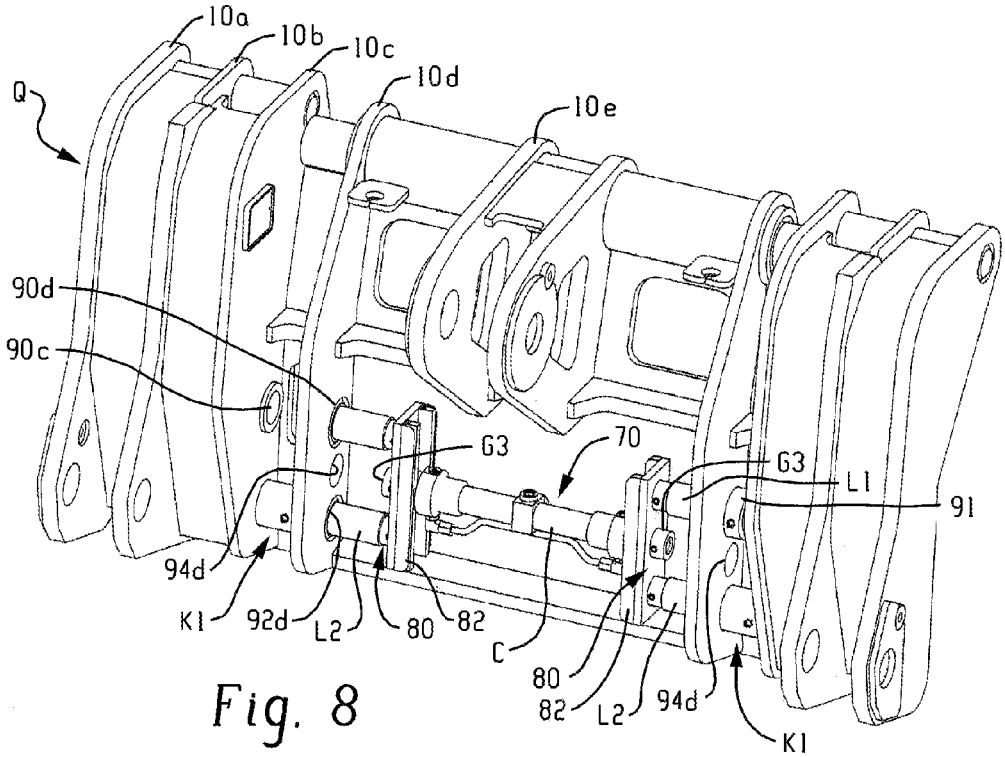
FIG. 8 is a rear isometric view of the loader coupler showing the locking system unlocked.
Figure 9A:
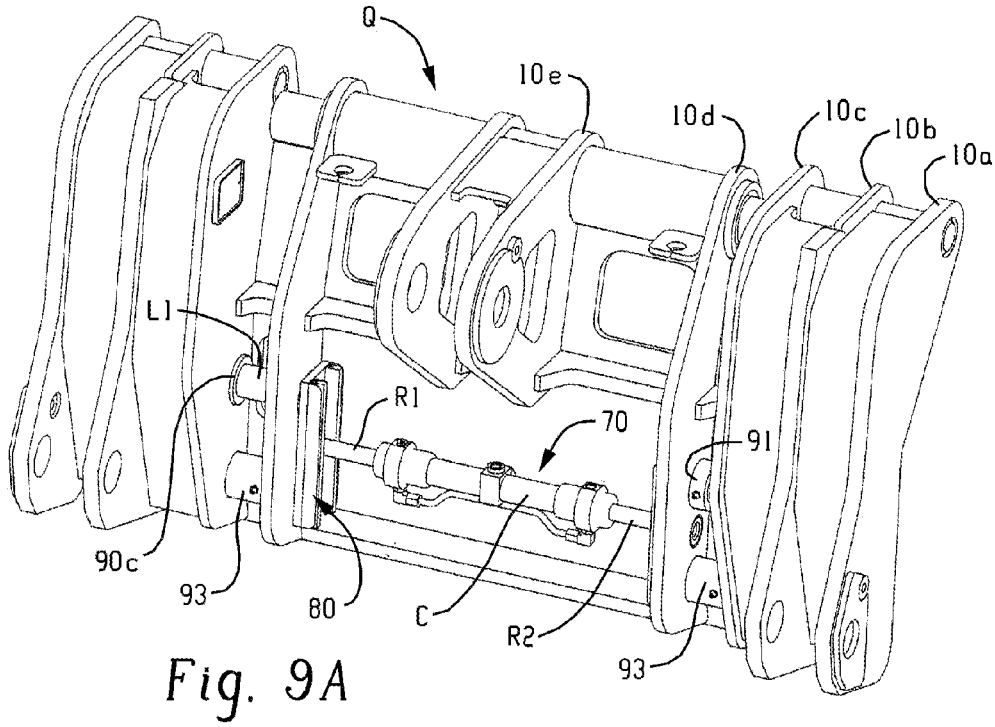
FIGS. 9A, 9B and 9C are rear isometric, rear elevation and front elevation views of the loader coupler showing the locking system in its locked state.
Figure 9B:
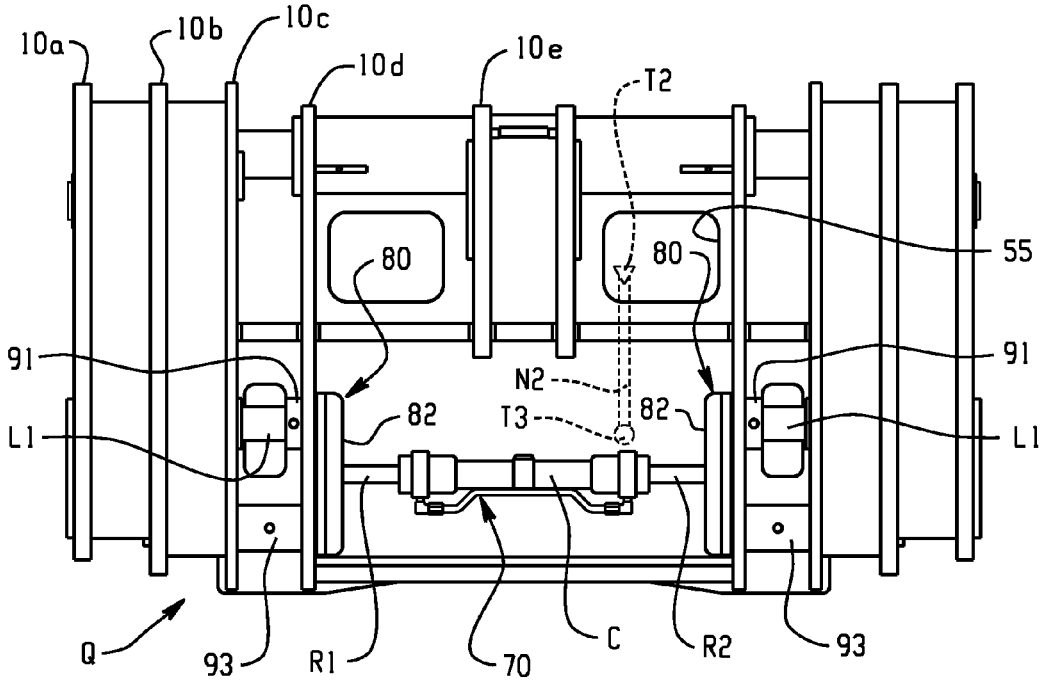

To releasably secure the first type of attachment coupling structure F1 (and the attachment AT1 connected thereto) to the coupler body B, or to releasably secure the second type of attachment coupling structure F2 (and the attachment AT2 connected thereto) to the coupler body B, the quick coupler Q further comprising a lock system 70, which is described now with primary reference to FIG. 8 and FIGS. 9A-9C. In the illustrated embodiment, the lock system 70 comprises at least one lock actuator such as a hydraulic cylinder or other actuator. In the illustrated preferred embodiment, the lock actuator comprises only a single fluid cylinder C including left and right rods R1,R2 (FIG. 9A) that are selectively movable by fluid pressure to and between a retracted position (FIG. 8) to an extended position (FIGS. 9A,9B). Alternatively, the rods R1,R2 can be respectively provided as part of two separate hydraulic cylinders that are provided as part of the lock system 70 in place of the single cylinder C. The rods R1,R2 preferably move simultaneously in a common horizontal plane between their retracted and extended positions. The cylinder C or other actuator is mounted adjacent a rear surface of the face plate 50.

The left and right rods R1,R2 are respectively operably connected to left and right lock plunger assemblies 80. Each plunger assembly 80 comprises: (i) a base plate 82 connected by welding, fasteners or otherwise to the rod R1,R2; and, (ii) first and second spaced-apart lock plungers L1,L2 that project laterally outward from the base plate in a common direction. The first and second lock plungers L1,L2 are preferably arranged horizontally and parallel to each other and are preferably defined by respective cylindrical members. A locator boss/plunger or like projection G3 is located between the two lock plungers and also projects outwardly from the base plate 82. The left and right lock plunger assemblies 80 are thus movably connected to the coupler body B for movement between extended (locked—FIGS. 9A,9B,9C) and retracted (unlocked—FIG. 8) positions by the rods R1,R2.

Figure 9C:
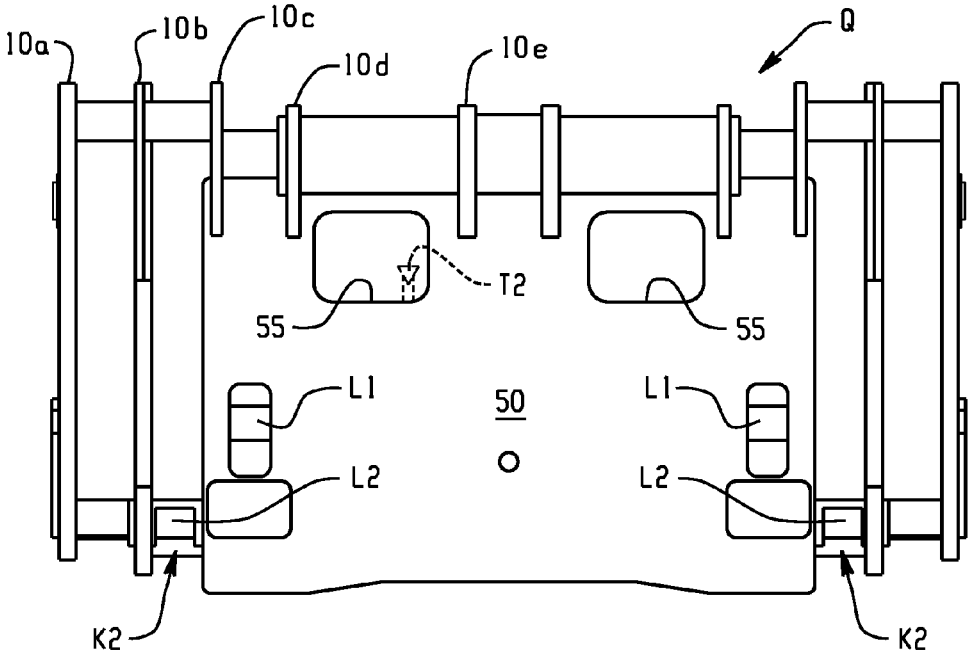

In the illustrated embodiment, for both the left and right coupler portions LP, RP, the ribs 10*c*,10*d* define respective plunger apertures 90*c*,90*d* (see also FIGS. 5B,5C) that are coaxial with respect to a first lock plunger axis. The aperture 90*d* includes a boss 91 that can be greased. The first lock plunger L1 is slidably supported in the boss 91 and is selectively movable outward to an extended (locked) position where it extends into and preferably spans the inner lock channel K1 and is received in the aperture 90*c* as shown in FIGS. 9A-9C. In the extended position, the first lock plunger L1 extends through the aperture EA of an ear E of the rib R1 of a first type of attachment coupling structure F1 located in the inner lock channel K1 to prevent withdrawal of the ear E from the inner lock channel K1. The first lock plunger L1 is also slidably movable from the extended position to a retracted (unlocked) position where it is at least partially withdrawn from and does not span the inner lock channel K1 so that it does not obstruct movement of a rib ear E of a first type of attachment coupling structure F1 into or out of the inner lock channel K1 (FIGS. 3,8).

Figure 4:
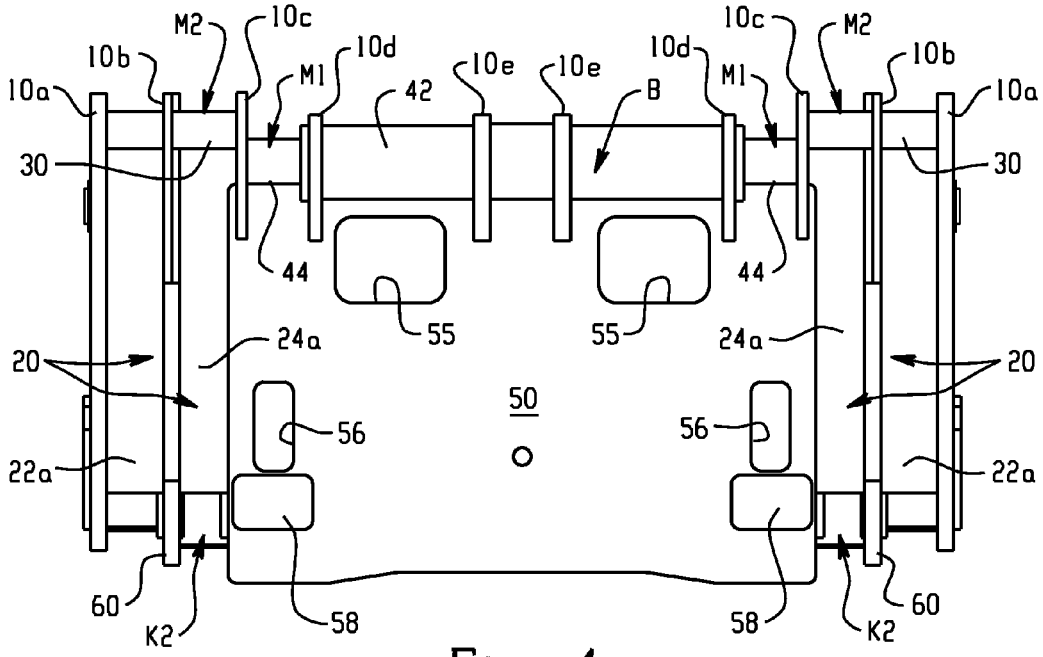
FIG. 4 is a front view of the loader coupler with the attachment locking system in its unlocked state.

Similarly, for both the left and right coupler portions LP,RP, as shown e.g., in FIGS. 1 and 5B-5D, the ribs 10*b*,10*c*, 10*d* define respective plunger apertures 92*b*,92*c*,92*d* that are coaxial with respect to a second lock plunger axis. A boss 93 (FIG. 3) that can be greased is supported in the apertures 92*c*,92*d* and spans the space between the ribs 10*c*,10*d*. The second lock plunger L2 is slidably supported in the boss 93 and is selectively movable outward to an extended (locked) position (FIGS. 9B,9C) where it extends into and preferably spans the outer lock channel K2 and is received in the aperture 92*b*. In the extended position, the second lock plunger L2 extends through the aperture EA of an ear E of the rib R2 of a second type of attachment coupling structure F2 located in the outer lock channel K2 to prevent withdrawal of the ear E from the outer lock channel K2. The second lock plunger L2 is also slidably movable from the extended (locked) position to a retracted (unlocked) position (FIGS. 3, 4 and 8) where it is at least partially withdrawn from and does not span or otherwise obstruct the outer lock channel K2 so that it does not obstruct movement of a rib ear E of a second type of attachment coupling structure F2 into or out of the outer lock channel K2 (FIGS. 3,4). The ribs 10*d* of the coupler body B further define a locator aperture 94*d* (FIG. 8) into which the locator plunger G3 is received when the plunger assemblies 80 are moved to their extended (locked) positions for added strength and to facilitate alignment of the plunger assemblies 80. Because the left and right cylinder rods R1,R2 are connected to the base plates 82 of the left and right plunger assemblies 80, the first and second lock plungers L1,L2 and the locator plunger G3 of each plunger assembly move in unison as controlled by the hydraulic cylinder C or other actuator.

When the coupler Q is fully mated with the first type of attachment coupling structure F1 as described above, the eye apertures EA of the left and right female ribs R1 are located in the left and right inner locking channels K1 and are aligned with the first lock plungers L1, and movement of the left and right plunger assemblies 80 from their retracted (unlocked) positions to their extended (locked) positions will cause the first lock plungers L1 to extend through the aligned eye apertures EA to capture the ribs R1 to the coupler body for use of the bucket or other attachment to which the ribs R1 are connected. Likewise, when the coupler Q is fully mated with the second type of attachment coupling structure F2 as described above, the eye apertures EA of the left and right female ribs R2 are located in the left and right outer locking channels K2 and are aligned with the second lock plungers L2, and movement of the left and right plunger assemblies 80 from their retracted positions to their extended positions will cause the second lock plungers L2 to extend through the aligned eye apertures EA to capture the ribs R2 to the coupler body for use of the bucket or other attachment to which the ribs R2 are connected. When the plunger assemblies 80 are in their retracted (unlocked) positions, the coupler body B is able to be freely mated and separated from either the first type of attachment coupling structure F1 or the second type of attachment coupling structure F2, because the first and second locking plungers L1,L2 do not obstruct the inner and outer locking channels K1,K2 for either the left or right coupler portion LP,RP.

Those of ordinary skill in the art will recognize that a main advantage flowing from the separate first and second locking plungers L1,L2 for the left and right plunger assemblies 80 is that the eye apertures EA of the first type of attachment coupling structure F1 and the eye apertures EA of the second type of attachment coupling structure F2 need not be located along a common locking axis as would be the case if a single locking plunger was used to capture both the first and second types of attachment coupling structures F1,F2 to the coupler body. This, then, allows the inner rib mounts M1 and outer rib mounts M2 to be located where desired to optimize the geometry when an attachment AT1 or AT2 is operably connected to the coupler, i.e., the mounts need not be located to preserve a single common locking plunger axis.

Figure 10A:
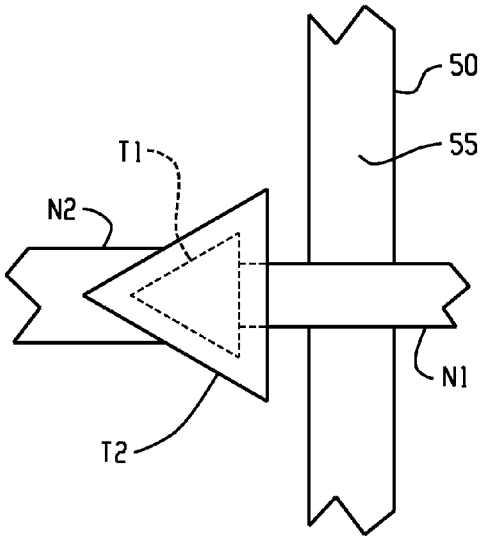
FIGS. 10A and 10B illustrate respective embodiments of a third-function hydraulic/electrical coupling system that is optionally provided as part of a loader coupler formed in accordance with the present development.
Figure 10B:
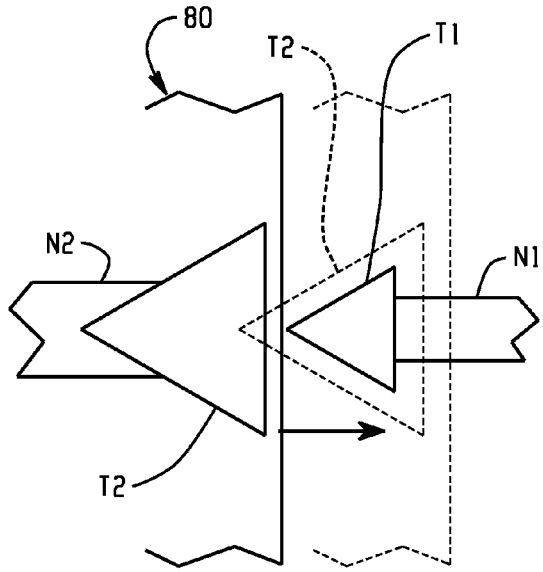

Attachments such as the attachments AT1,AT2 are optionally equipped with a hydraulically or electrically powered third-function actuator such as a thumb, grapple, powered broom, or other powered actuator as in generally known in the art. In such case, the attachment comprises one or more hydraulic or electric control lines that feed and return from the third-function actuator, including fittings (plug or coupling) that mate with corresponding fittings (plug or coupling) of a hydraulic or electric system of the loader machine or other machine to which the coupler Q is operatively connected. According to the present development, the coupler Q optionally comprises a system for third-function hydraulic/electric connection. With reference to FIG. 6A, an attachment optionally comprises at least one hydraulic or electric control line N1 including a hydraulic or electric fitting T1 (broken lines are used to indicate the option nature of the control line N1 and fitting T1). The coupler Q, as shown in FIGS. 9B,9C optionally comprises at least one corresponding hydraulic or electric control line N2 having fittings T2,T3 at its opposite ends (broken lines are used to indicate the optional nature of the control line N2 and fittings T2,T3). The fitting T3 is conventional and adapted to be manually mated with the corresponding hydraulic or electric system of the loader or other machine to which the coupler Q is operably coupled. The fittings T1 and T2, whether electric or hydraulic, are adapted to mate with each other in a quick-connect/quick-disconnect fashion, with one being a male fitting and the other being a female fitting as shown in FIG. 10A. Furthermore, the fitting T1 is located on the attachment AT1 and the fitting T2 is located on the coupler Q so that when the coupler Q is operably mated with the attachment AT1 as described above, the fittings T1,T2 are aligned with each other and mate as part of the process of the coupler Q mating with the attachment AT1 without any manual effort by an operator or assistant. As shown herein, the fittings T1,T2 mate through one of the face plate openings 55. In an alternative embodiment as shown in FIG. 10B, the fitting T2 is connected to one of the plunger assemblies 80 and mates with the fitting T1 when the plunger assemblies moves from the unlocked to the locked position, and decouples from the fitting T1 when the plunger assembly 80 is retracted.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A loader coupler comprising:

a body comprising a front region, a rear region, an upper region, a lower region, and left and right lateral sides, a tilt actuator pin-on location, and left and right arm pin-on locations;

left and right laterally spaced-apart inner rib mounts provided on the body and adapted to mate respectively with left and right ribs of a first type of attachment coupling structure;

left and right inner locking regions defined by the body and vertically aligned with the left and right inner rib mounts, respectively;

left and right laterally spaced-apart outer rib mounts provided on the body and adapted to mate respectively with left and right ribs of a second type of attachment coupling structure;

left and right outer locking regions defined by the body and vertically aligned with the left and right outer rib mounts, respectively;

a lock system comprising: (i) a hydraulic cylinder having left and right cylinder rods that are each selectively extensible and retractable; and, (ii) left and right plunger assemblies respectively connected to said left and right cylinder rods and each adapted to move between a locked and unlocked position, said left and right plunger assemblies each comprising a first lock plunger located on a first lock plunger axis and a second lock plunger located on a second lock plunger axis, wherein said first lock plunger axis and said second lock axis lie in different parallel, spaced-apart horizontal planes;

wherein said left and right first lock plungers extend into said left and right inner locking regions when said left and right plunger assemblies are located in said locked position such that said left and right first lock plungers are respectively adapted to mate with and capture left and right ribs of a first type of associated attachment structure when the first type of associated attachment structure is mated with said left and right inner rib mounts, said left and right first lock plungers at least partially withdrawn from said left and right inner locking regions when said left and right plunger assemblies are located in said unlocked position; and, wherein said left and right second lock plungers extend into said left and right outer locking regions when said left and right plunger assemblies are located in said locked position such that said left and right second lock plungers are respectively adapted to mate with and capture left and right ribs of a second type of associated attachment structure when the second type of associated attachment structure is mated with said left and right outer rib mounts, said left and right second lock plungers at least partially withdrawn from said left and right outer locking regions when said left and right plunger assemblies are located in said unlocked position.

2. The coupler as set forth in claim 1, wherein said body further comprises a face plate located between said upper and lower regions, said hydraulic cylinder located adjacent a rear surface of said face plate.

3. The coupler as set forth in claim 1, wherein said body comprises left and right body portions defined respectively between a vertical centerline and said left and right lateral sides, each of said left and right body portions comprising a plurality of parallel and spaced-apart vertically extending ribs.

4. The coupler as set forth in claim 3, wherein:

said left and right pin-on locations are located between a first pair of ribs of said left and right body portions, respectively;

said left and right outer ribs mounts and said left and right outer locking regions are located between a second pair of ribs of said left and right body portions, respectively; and, said left and right inner ribs mounts and said left and right inner locking regions are located between a third pair of ribs of said left and right body portions, respectively.

5. The coupler as set forth in claim 4, wherein said tilt actuator pin-on location is defined between a fourth pair of ribs of said body, wherein one of said ribs of said fourth pair is part of said left body portion and the other of said ribs of said fourth pair is part of said right body portion.

6. The coupler as set forth in claim 4, wherein:

said left and right outer locking regions comprises left and right outer locking channels defined between said second pair of ribs of said left and right body portions, respectively; and, said left and right inner locking regions comprises left and right inner locking channels defined between said third pair of ribs of said left and right body portions, respectively.

7. The coupler as set forth in claim 6, wherein:

an outer box frame comprising front and rear spaced-apart outer plates is defined between and interconnects the first pair of ribs for both said left and right body portions; and, an inner box frame comprising front and rear spaced-apart inner plates is defined between and interconnects the second pair of ribs for both said left and right body portions.

8. The coupler as set forth in claim 4, wherein said upper portion of said body comprises a horizontally extending main upper support that is connected to an inner rib of said third pair of ribs for both said left and right body portions, wherein said left and right inner rib mounts comprises respective left and right inner cross-bars that extend between said third pair of ribs of said left and right body portions and that are connected to left and right ends of said main upper support, respectively.

9. The coupler as set forth in claim 8, wherein said left and right inner cross-bars are respectively received into open left and right ends of said main upper support.

10. The coupler as set forth in claim 8, wherein said left and right outer rib mounts respectively comprise left and right outer cross-bars that extend between said second pair of ribs of said left and right body portions, respectively, wherein said left and right inner cross-bars partially over lap said left and right outer cross-bars, respectively, wherein said left and right outer cross-bars define recesses that conform to and receive overlapping portions of said left and right inner cross-bars, respectively.

11. The coupler as set forth in claim 1, wherein said left and right inner rib mounts are mated respectively with left and right ribs of an associated attachment comprising the first type of attachment coupling structure, said left and right ribs of the first type of attachment coupling structure comprising left and right eye portions including left and right eye apertures, respectively, wherein said respective eye portions of said left and right ribs are located in said left and right inner locking regions and said left and right first lock plungers are received through said left and right eye apertures, respectively, when said left and right plunger assemblies are located in their locked positions.

12. The coupler as set forth in claim 1, wherein said left and right outer rib mounts are mated respectively with left and right ribs of an associated attachment comprising the second type of attachment coupling structure, said left and right ribs of the second type of attachment coupling structure comprising left and right eye portions including left and right eye apertures, respectively, wherein said respective eye portions of said left and right ribs are located in said left and right outer locking regions and said left and right second lock plungers are received through said left and right eye apertures, respectively, when said left and right plunger assemblies are located in their locked positions.

13. A loader coupler comprising:

a body comprising a front region, a rear region, an upper region, a lower region, and left and right lateral sides, a tilt actuator pin-on location, and left and right arm pin-on locations;

left and right laterally spaced-apart inner rib mounts provided on the body and adapted to mate respectively with left and right ribs of a first type of attachment coupling structure;

left and right inner locking regions defined by the body and vertically aligned with the left and right inner rib mounts, respectively;

left and right laterally spaced-apart outer rib mounts provided on the body and adapted to mate respectively with left and right ribs of a second type of attachment coupling structure;

left and right outer locking regions defined by the body and vertically aligned with the left and right outer rib mounts, respectively;

a lock system comprising left and right plunger assemblies that each move between a locked and unlocked position, said left and right plunger assemblies each comprising a first lock plunger located on a first lock plunger axis and a second lock plunger located on a second lock plunger axis; wherein:

said left and right first lock plungers extend into said left and right inner locking regions when said left and right plunger assemblies are located in said locked position, and wherein said left and right first lock plungers are at least partially withdrawn from said left and right inner locking regions when said left and right plunger assemblies are located in said unlocked position; and, said left and right second lock plungers extend into said left and right outer locking regions when said left and right plunger assemblies are located in said locked position, and wherein said left and right second lock plungers are at least partially withdrawn from said left and right outer locking regions when said left and right plunger assemblies are located in said unlocked position;

said body comprises left and right body portions defined respectively between a vertical centerline and said left and right lateral sides, each of said left and right body portions comprising a plurality of parallel and spaced-apart vertically extending ribs;

said left and right pin-on locations are located between a first pair of ribs of said left and right body portions, respectively;

said left and right outer ribs mounts and said left and right outer locking regions are located between a second pair of ribs of said left and right body portions, respectively;

said left and right inner ribs mounts and said left and right inner locking regions are located between a third pair of ribs of said left and right body portions, respectively; and wherein, on both said left and right body portions:

said first pair of ribs of comprises a first rib and a second rib;

said second pair of ribs comprises said second rib and a third rib;

said third pair of ribs comprises said third rib and a fourth rib.

14. The coupler as set forth in claim 11, wherein one of the left and right plunger assemblies comprises a hydraulic fitting adapted to mate with a third-function hydraulic fitting of the associated attachment mated with the coupler.

* * * * *